US005397054A

United States Patent [19]

Ziegs

[11] Patent Number: 5,397,054

[45] Date of Patent: Mar. 14, 1995

[54] PRESSURE JET CLEANING APPLIANCE

[75] Inventor: Carsten Ziegs, Hamburg, Germany

[73] Assignee: Dolmar GmbH, Hamburg, Germany

[21] Appl. No.: 109,726

[22] Filed: Aug. 20, 1993

[30] Foreign Application Priority Data

Aug. 26, 1992 [DE] Germany ..... 9211472 U
Jun. 8, 1993 [DE] Germany ..... 9308524 U
Jun. 8, 1993 [DE] Germany ..... 9308525 U

[51] Int. Cl.[6] ..... B08B 3/02

[52] U.S. Cl. ..... 239/126; 239/570; 239/124

[58] Field of Search ..... 239/124, 126, 127, 526, 239/570, 578, 583

[56] References Cited

U.S. PATENT DOCUMENTS 3,147,767 9/1964 Goss ..... 239/127
3,977,603 8/1976 Magee, Jr. .
4,238,073 12/1980 Liska ..... 239/127
4,385,640 5/1983 Iverson ..... 239/127
5,228,622 7/1993 Murphy et al. ..... 239/127

FOREIGN PATENT DOCUMENTS 1247547 8/1967 Germany ..... 239/127
WO90/08602 8/1990 WIPO .

*Primary Examiner*—Karen B. Merritt
*Attorney, Agent, or Firm*—Townsend and Townsend Khourie and Crew

[57] ABSTRACT

A pressure jet cleaning appliance having a pressure pump (10) driven by a drive (11). The appliance includes a conduit having a primary line (14) for directing fluid into a spray gun (15) and a bypass line (19) for recycling fluid through the conduit when the spray gun is turned off. A control valve (18) has a reciprocal piston (28) responsive to fluid pressure within the primary line such that the piston moves into a closed position thereby directing fluid through the bypass line when the spray gun is turned off. The piston is directly connected to a control element (22) in the drive such that movement of the piston is translated into displacement of the control element. With this configuration, the piston actuates the control element to reduce the speed of the drive when the piston is in the closed position and to increase the speed of the drive when the piston is in the open position.

15 Claims, 7 Drawing Sheets

PRESSURE JET CLEANING APPLIANCE

BACKGROUND OF THE INVENTION

The present invention relates to a pressure jet cleaning appliance with a pressure pump driven by a driving means from whose pressure pipe a bypass pipe, which, when the pressure pipe is closed, is opened by means of a closing valve provided with a closing element, leads to the suction pipe of the pressure pump and having a control element that is connected to a governor of the driving means.

In non-stationary operating pressure jet cleaning appliances, an electromotor or an internal combustion engine is frequently employed as driving means of the pressure pump that is operated at a constant rotational speed. In the case of the electromotor, the rotational speed control is effected independently of the load by means of the fixed number of poles and the constant mains frequence and, in the case of the internal combustion engine, by means of a rotational speed-dependent throttle valve position. In such a case the control of the system is effected in that, with the opened spray gun, the driving means drives the pressure pump with the power that is necessary for the operation of the pressure jet cleaning appliance. When the spray gun is then closed with the aid of the normally provided control handle, a bypass closing valve enters into action in such a way that, when the pressure pipe is closed by the spray gun, a bypass pipe to the suction pipe opens so that the pressure pump then delivers the cleaning fluid into the circulation. The power of the pressure pump that is necessary in this bypass operation is considerably less than the power required in the normal spraying, squirting or cleaning operation.

In order to reduce the noise development and the wear during the operating intervals (bypass operation), a control is expediently effected in that, when the pressure pipe is closed, the driving means is regulated down to a rotational speed that is lower than the nominal operating speed.

For this, in a known high-pressure jet cleaning appliance, a pressure sensor is provided in the pressure pipe which detects the pressures which occur inside the pressure pipe, in particular the lowering of the pressure which occurs after the closing of the pressure pipe and the opening of the bypass valve connected therewith, and the increase in the fluid pressure which occurs in the pressure pipe following the reopening of the pressure pipe and reduces the rotational speed of an internal combustion engine provided as driving means as soon as the pressure in the pressure pipe, due to the opening of the bypass valve, drops below a certain value and, when a certain pressure value is exceeded, once more adjusts the throttle control rod of the internal combustion engine to an increase in the rotational speed (DE 39 02 252 C1).

However, this method of regulation is subject to various disadvantages. For it has to be stated that such a control system operates according to quite specific pressure changes which arise in the pressure pipe under quite specific directions subsequent to the opening or closing of the bypass valve, said changes being then utilized for the control. This means that the control is merely able to lag timewise behind the pressure conditions occurring, that is to say, the control becomes only effective when a rise in pressure or a drop in the pressure has taken place.

Furthermore, in pressure jet cleaning appliances there arises the problem that an operation of the pressure jet cleaner is only possible at one pressure, viz. the maximum pressure, independently of the circumstance whether this pressure is actually required. That is why it is desirable to adapt the pressure of the squirted-out cleaning medium as well as the driving power needed herefor to the case of application. With the DE 39 22 956 A1, a high-pressure jet cleaning device has already been proposed which comprises a high-pressure pump, a pressure pipe leading from the latter to a closable outlet, a bypass pipe leading from the same to the induction side of the pump and a closing valve that closes the bypass pipe. The device makes an automatic pressure discontinuation of the pump possible when closing the outlet, is constructed in such a way that, upstream of the outlet and downstream of the branching of the bypass pipe, a flow controller is provided which closes the closing valve of the bypass pipe when the outlet is closed. In this case the closing valve is constructed in the form of a closing valve and provision has been made for an adjustable stop, with the aid of which the closing motion of the closing valve can be limited. However, with such a set-up, only the volume flow is regulated.

This invention is based upon the technical problem of constructing, in a pressure jet cleaning appliance of the type stated in the beginning, a control in such a way that the same is independent of pressure changes that occur due to the closing or opening of the closing valve and, more particularly, prior to the occurrence of these pressure changes, adjusts the rotational speed of the driving means.

SUMMARY OF THE INVENTION

The regulation is effected on this occasion in such a way that the closing element of the closing valve of the bypass pipe and the governor of the driving means are in direct operative connection and that, when the closing valve is opened and the bypass line connected therewith is unblocked, the governor is adjusted so as to reduce the rotational speed of the driving means and, when the closing element is closed and the closing connected therewith of the bypass pipe, a corresponding increase in the rotational speed takes place. This solution offers the special advantage that the control does not lag behind the adjustment of the bypass valve.

In this case it is especially provided that the closing element of the bypass valve which either closes or unblocks the bypass pipe, is connected with the control element of the driving means with the aid of a Bowden control cable. The control element may be a controller or switch of an electromotive drive or a contact in an electronic motor control or the adjustment rods controlling the throttle valve of an internal combustion engine.

In this case the coupling is such that, in the open position of the bypass, a desired no-load rotational speed of the driving means is set. By means of the bypass valve which closes when the spray gun is opened, a movement is thus transmitted by the control element via the Bowden control cable onto the control element of the driving means which adjusts the driving means in its operating rotational speed, or in its operating point, respectively.

According to a preferred embodiment of the invention, it is provided that the closing element and the control element are interconnected, in which case the closing valve is provided with a valve body wherein a cylinder chamber is constructed. The cylinder chamber possesses an inlet part that is connectable to the pressure pipe and an outlet part that is connectable to a pressure spray gun supply line and which, in the direction toward the bypass line, is delimited by a sealing member and possesses an adjusting piston which is movable in the valve body, upon which the closing piston is mounted, which interacts with the seating member and is displaceable into a position which opens the branch duct.

In this case the central idea consists in that a plunger valve is employed. By the employment of a plunger valve it can be achieved that the piston and, consequently, also the control element, has to be caused to travel a predetermined path before the circulation via the bypass line is unblocked. This path suffices for actuating, by way of example, a throttle valve in the carburetor of an internal combustion engine.

A further advantage consists in that even a furred bypass valve is opened owing to the powerful forces and the throttle valve is closed so that on no account any danger exists that, with a closed lance or spray gun, the full pressure is applied to the system and a component part possibly destroyed. For the next adjustment "open lance" two possibilities exist Either the bypass valve becomes operative once more when the lance was closed, i.e. when the valve was "opened" and functions again or it remains in the opened state and that is why a servicing is called for. At any rate, a distinct safety is provided since, when the valve no longer functions, the appliance is in the low pressure range.

It is advantageously provided that the seating member is constructed in the form of a sleeve-like piece of piping which is provided with a seating section, whose internal diameter corresponds to the external diameter of the bolt-like constructed valve piston and consequently is tight.

Moreover, the closing piston is provided with a passage section, within which the seating piston cross-sectional area is reduced by the reduced open faces constructed on the piston skirt area. The difference between the closing piston cross-sectional area in the seating section and the closing piston cross-sectional area within the region of the open faces corresponds to the passage cross-section. The open faces are, in their length in the direction of displacement of the closing piston (opening length), longer than the seating length of the seating section of the seating member and, at a pertinent displacement of the closing piston, open passage apertures for the medium, which is thus able to flow from the pressure pipe into the bypass line, in which case the open faces can be constructed both in the form of flattenings as well as e.g. in the form of grooves. What is important is that a part of the cylinder or boat contour of the valve piston is preserved so as to ensure an as jerk-free as possible travel of the plunger in the valve seat. For this it is provided that the internal diameter of the seating section and the external diameter of the bolt-like-constructed closing piston correspond to each other next to the open faces in such a way that the seating piston is guided in the seating member.

It is possible to make provision for a valve closing spring to be disposed between the seating element and the adjusting piston. According to the basic construction and basic principle of the closing valve and with an appropriate layout of the adjusting piston surfaces relative to each other, the valve also functions without a spring. However, by incorporating a compression spring, the sequence "lance open close bypass valve" can be expedited for, as soon as the lance is opened, the Venturi tube enters into action and reduces the pressure on the outside of the adjusting piston. Since the pressure difference between the outside and the inside of the adjusting piston is slight on account of the low overall pressure, it may happen that the valve closes only sluggishly. By means of the spring the closing operation is speeded up and the governor of the driving means is adjusted earlier in the full load direction. On this occasion it suffices when the spring is dimensioned in such a way that it is displaced by the closing piston in such a fashion that the open faces are just closed since the entire volume flow then streams already through the Venturi tube and the pressure difference at the adjusting piston then increases. The spring is not absolutely necessary, but brings the advantage that the valve is able to react more speedily to an opening of the lance.

In order to achieve a certain opening of the valve it is advantageously provided that the opening length of the passage section, i.e. of the open face, in the direction of the displacement of the closing piston, amounts to approximately twice the seating length of the sealing member.

On top of that it is possible to provide a second compression spring which is disposed between the rear of the adjusting piston and the valve body. Said spring supports the adjusting piston against the valve body housing and results in the closing piston, in the pressure-free state of the bypass valve, being adjusted into a position which, when the driving means is regulated, corresponds to a partial load position or in a partial throttle position. When an internal combustion engine is employed as driving means, halfway throttle is preferably set, which results in that, already when the internal combustion engine is switched off, the throttle valve is automatically brought into a suitable starting position.

According to a further preferred embodiment it is provided that the closing element or the control element can be made to rest against an adjustable stop which serves to restrict the displacement path or regulating path and, consequently, a predetermined operating pressure is adjustable and, even after a squirting break, can be immediately started once more.

This regulation has the advantage that the power generated can at all times be adapted to the requirement, i.e. the desired pressure. For this, an adjusting possibility of the control element of the driving means is provided, with the aid of which the movement of the control element in the direction of the maximal power, i.e. the adjustment of the throttle valve of an internal combustion engine is limited to "completely opened" or the adjustment of the governor or switch of an electromotor to "full power" so that the driving power is limited and the pump pressure regulated hereby. The main advantage vis-a-vis the known systems resides there in that only so much power is made available to the pump as is also actually required and no superfluous power is nullified by a pressure reduction in the bypass pipe.

Advantageously provision is made for the stop to be constructed so as to be continuously adjustable, e.g. in the form of a threaded boat with a handle such as a rotary button so that, for the user, a setscrew is available. With the aid of said screw the user is able to set that the control element is no longer able to adjust a throttle valve to full load, but only to partial load so that then, during the squirting operation, the torque characteristic curve of the drive and the load characteristic curve of the pump would intersect already at a lower rotational speed, so that the pump generates a lower pressure.

Thus the possibility of a continuous regulation and power adaptation has been provided, in which connection it is particularly advantageous that the regulation is able to act in combination with a bypass valve, which makes it possible to adjust the control element of the drive in such a way that the closing element of the closing valve of the bypass pipe and the governor of the driving means are in direct operative connection and that, when the closing valve is opened and the therewith connected unblocking of the bypass line of the governor is adjusted so as to reduce the rotational speed of the driving means and, when the closing element is closed and the therewith connected closing of the bypass line, a pertinent increase in the rotational speed takes place. This solution possesses the special advantage that the control does not lag behind the adjustment of the bypass valve so that additional excess pressures or pressure reductions do not have to occur until the control responds, whereby a speedy response is ensured and an acceleration of the drive is avoided when the spray gun is closed.

BRIEF DESCRIPTION OF THE DRAWINGS

Embodiment examples of the invention are explained in detail in the following with the aid of the drawings. Thus

DETAILED DESCRIPTION OF THE PREFERRED EMBODIMENT

Figure 1:
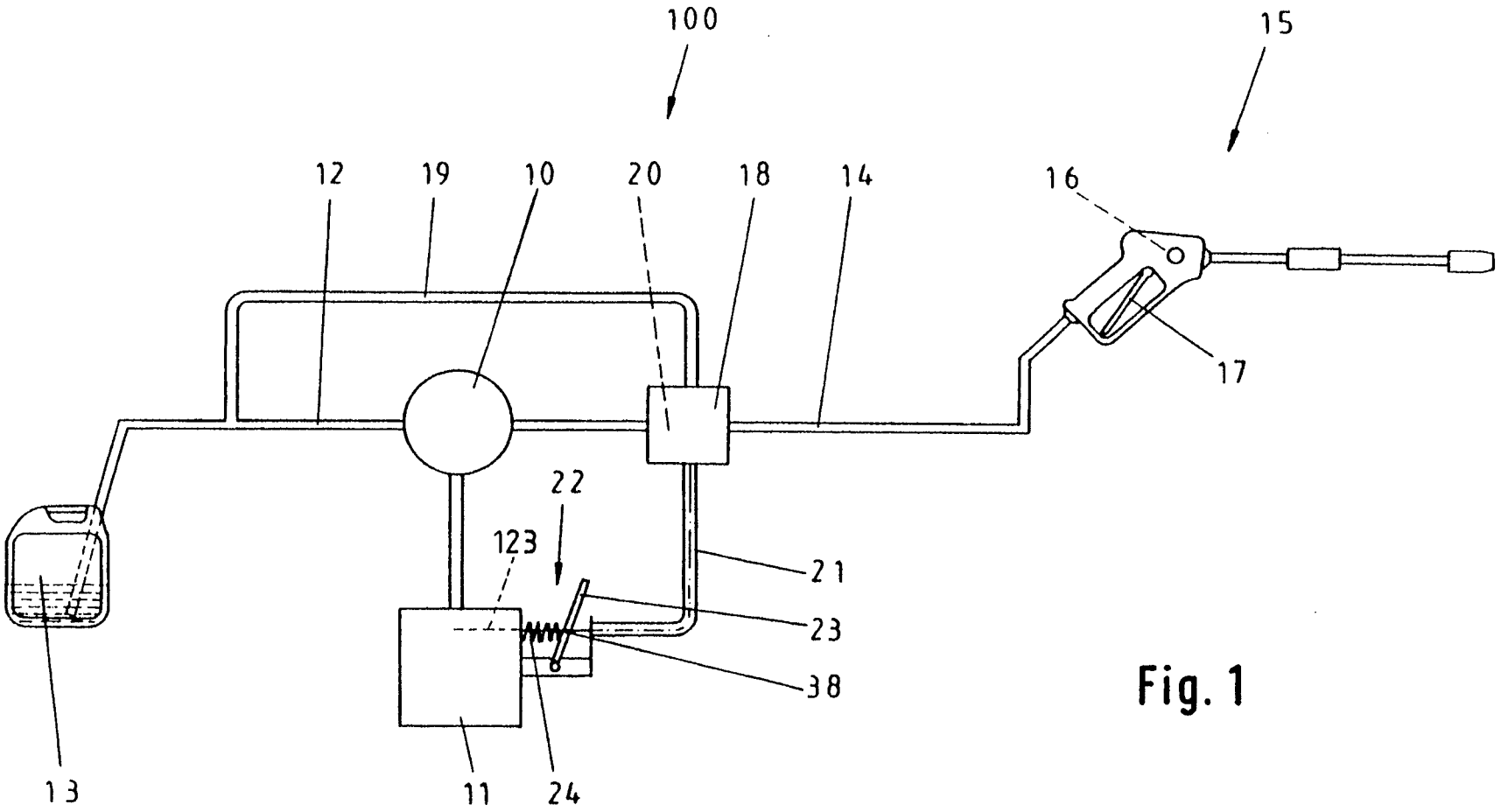
FIG. 1 shows a pressure jet cleaning appliance in a schematic representation.

In FIG. 1, the basic construction of a pressure jet cleaning appliance 100 is represented in a purely schematic manner. On this occasion, a pressure pump 10 is driven by a driving means 11, in which the suction pipe 12 of the pressure pump 10 communicates with a storage container 13 or a cleaning fluid supply line not depicted in the drawing, while the pressure pipe 14 communicates with a conventional high-pressure spray gun 15, whose internal control valve 16 can be brought into a closed and opened position with the aid of a hand lever 17.

In the pressure pipe 14, between the pressure pump 10 and the spray gun 15, a bypass closing valve 18 is provided which, by means of the closing element 20, opens and closes the bypass line 19 connected with the pressure pipe 14, in which case the bypass line leads from the pressure pipe 14 to the suction pipe 12 so as to make a delivery in the circulation with the spray gun (lance) 15 possible in the closed position.

The closing element 20 is connected via a Bowden control cable 21 to the control element 22 of the driving means 11. In this case the control element is comprised e.g. of a throttle control rod 23 connected to a throttle valve 123 of an internal combustion engine or actuates a switch or a speed governor of an electromotive drive.

Figure 2:
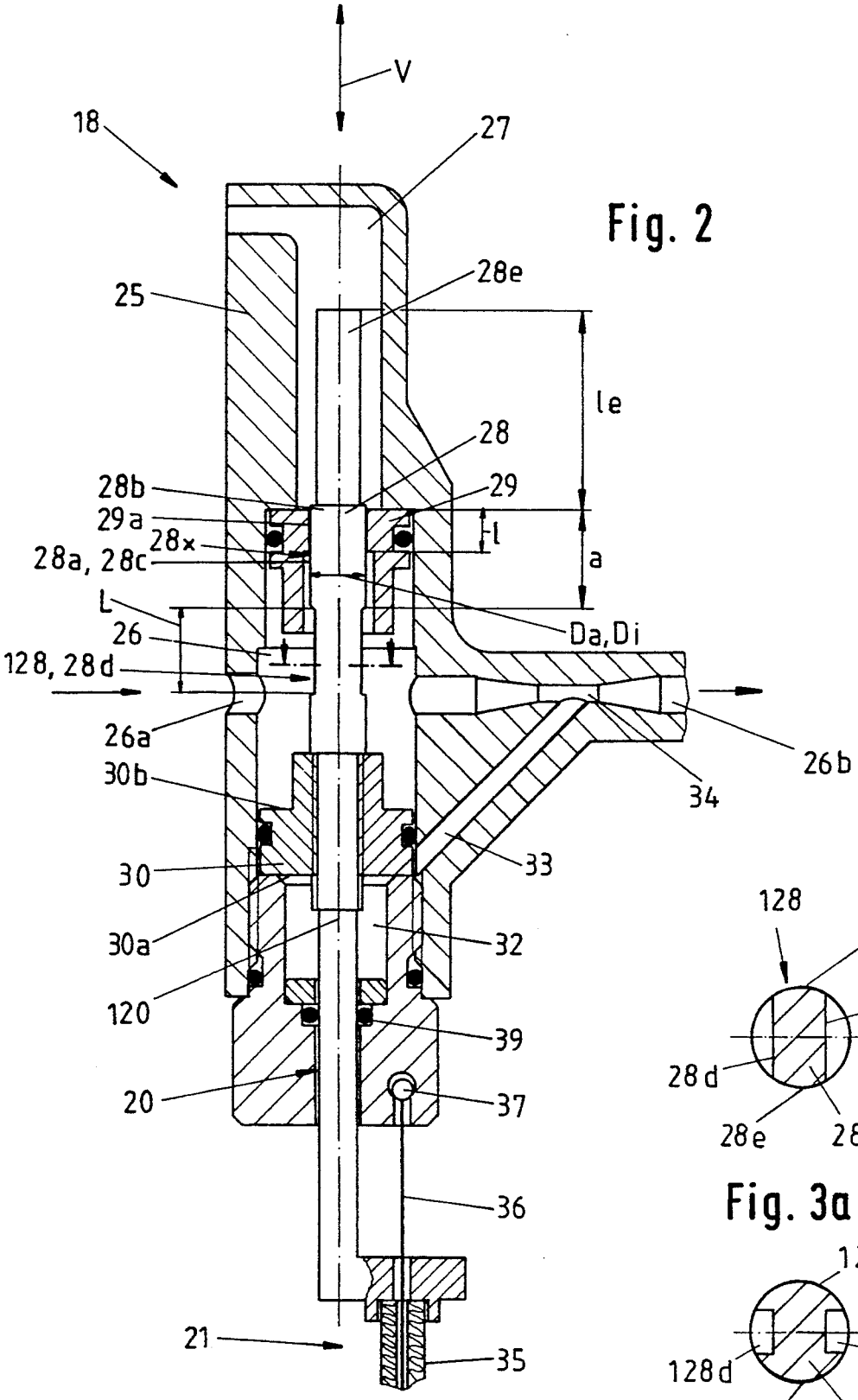
FIG. 2 shows, in a vertical sectional representation, an embodiment of a bypass closing valve in its closed position.
Figure 4:
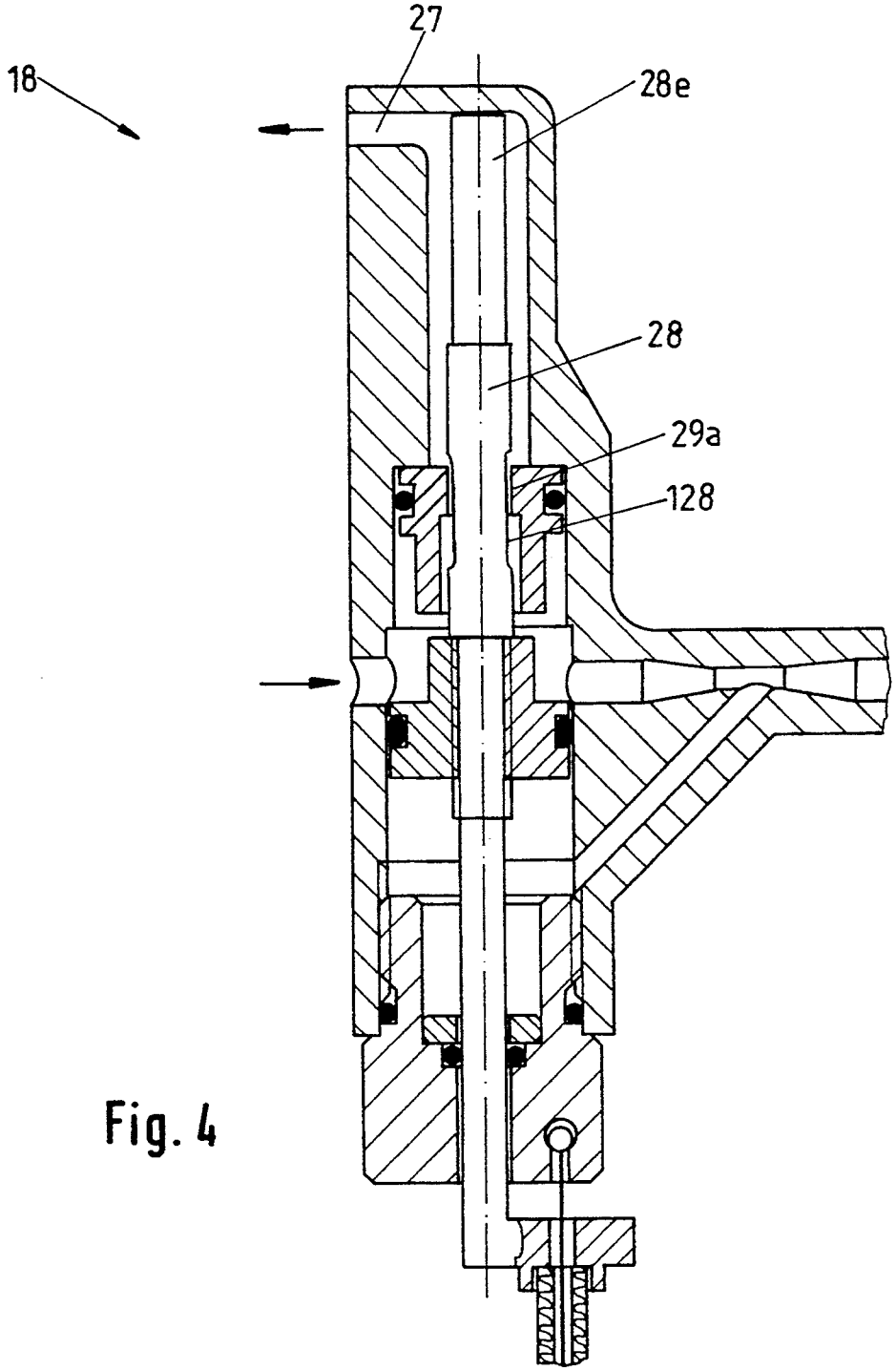
FIG. 4 shows the bypass closing valve according FIG. 2 in an opened position.

In the FIGS. 2 and 4, the connection and the method of operation of the closing valve 18 is depicted. In the valve body 25, the cylinder chamber 26 is constructed which, via the inlet part 26*a* and the outlet part 26*b*, communicates with the pressure pipe 14.

From this the branch duct 27 of the bypass line 19 branches off which can be closed by means of the closing element 20 with the closing piston 28, which acts in combination with the seating member 29. Upon the piston rod-like constructed closing element 20, an adjusting piston 30 is screwed which can be supported on a compression spring not shown which, in turn, is supported upon the seating member 29 so that the adjusting piston 30 always moves the closing element 20 and, with it, the closing piston 28, into its closing position so that a complete closure of the branch 27 is effected. Within the region of the adjusting piston 30, inside the valve body 25, the pressure chamber 32 is constructed which, via a pressure conduit 33, communicates with a Venturi constriction 34 in the passage 26.

The closing piston 28 is constructed in the form of a bolt and, on the external surface 28a, possesses an external diameter Da which corresponds to the internal diameter Di of the seating section 29*a* of the seating member 29 so that a sealing of the cylinder chamber in the direction toward the branch duct 27 exists. The closing piston 28 has its external diameter Da both within the region of the seating section 28*c* extending to the end 28*b* on the side of the branch duct and possessing a length a, as well as in the passage section 128, in which two constrictions 28*d* are constructed (FIG. 5*a*), which serve as open faces for the communication between the cylinder chamber 26 and the branch duct 27 when said passage section 128 is, by means of the displacement of the closing element 20 in the position shown in FIG. 4, viz. located opposite the seating section 29*a*. In the position of the closing piston 28 illustrated in FIG. 2, the sealing section 28*c* is located opposite the sealing section 29*a*, whereby not merely a seating, but also a guiding is achieved. In order to ensure a certain opening in the direction of the branch duct 27, it is provided for the passage section 128 to have twice the length L of the length 1 of the sealing section 29*a*. The non-constricted regions of the passage section 128 serve as guiding surfaces 28*e*, which likewise possess the diameter Da.

The spacer 28*e* follows the end 28*b* of the closing piston 28, whose length 1*e* is dimensioned in such a way that, when the bypass valve 18 is opened, the closing piston 28 is maintained in the fully opened position (FIG. 4).

Figure 3A:
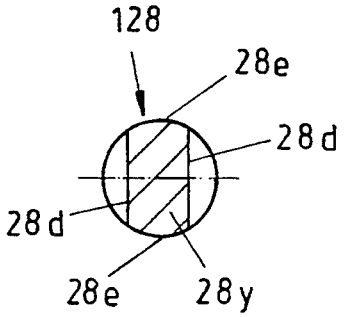
FIGS. 3*a*, 3*b* show embodiments of the open faces in the passage section of the closing piston in an enlarged sectional representation.
Figure 3B:
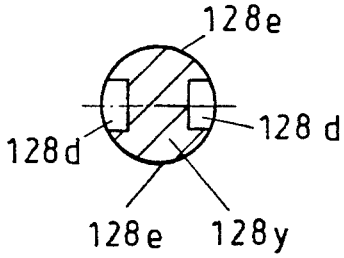

In FIG. 3*b*, a variant of the construction of the passage section 128 is depicted. On this occasion, the open faces are constructed in the form of grooves 128*d*, next to which the guiding surfaces 128*e* remain.

The mode of operation of the closing valve 18 is in this case such that, in the operating position shown in FIG. 2, a free passage of the cleaning medium through the cylinder chamber 26 is possible. In this connection, within the region of the Venturi tube 34, a reduced pressure is generated which, via the pressure duct 33 and the pressure chamber 32, acts upon the surface 30*a* of the adjusting piston. At the same time, the pressure of the pressure medium from the passage 26 acts upon the adjusting piston 30 from the other surface 30*b* reduced by the cross-section 28 of the control element 20, so that the difference in the force of expansion acts continuously in the direction of the bypass valve and retains the adjusting piston in the position shown in FIG. 2.

When the control valve 16 shown in FIG. 1 of the spray gun 15 is now closed, a flow through the Venturi tube 34 no longer takes place and the existing reduced pressure is discontinued, what follows is an application of the piston surface 30*a* of the adjusting piston 30 with the full pump pressure. Owing to the larger piston surface 30*a* facing the pressure chamber 32 in comparison with the surface 30*b* of the adjusting piston 30 reduced by the cross-section 28 of the control element 22 and facing the cylinder chamber 26, the same is now displaced into the position depicted in FIG. 4 and unblocks the branch duct 27.

The metallic hose 35 of the Bowden control cable 21 is supported on the closing element 20, whose steel cable 36 is hung with its terminal element 37 in the valve body 25. The other end 38 is hung on the control element 22 (FIG. 1). This means that the control element, e.g. the throttle control rod 23 of the driving means 11 constructed in the form of an internal combustion engine is, in its movement, rigidly coupled to the movement of the closing element 20. From this results a direct control.

When the control valve 16 of the spray gun 15 is closed, the volume flow in the pressure pipe drops immediately to 0 bar and the pressure in the pressure pipe 14 and, with this, also in the passage 26 of the closing valve 18 rises since the pressure pump 10 does, after all, continue to deliver. However, as soon as the reduced pressure in the Venturi tube 34 is cancelled due to the zero volume flow and an equalization of pressure takes place, the closing element 20 is displaced. This means that a displacement of the closing element 20 starts practically immediately when the volume flow collapses or the pressure in the pressure pipe 14 begins to rise. Once the pertinent pressure has built up, the closing element 20 and, with it, the closing piston 28, is adjusted into its opening position (FIG. 6), and the cleaning medium follows the path indicated by the arrows in FIG. 6. By means of the Bowden control cable 21, the control element 22 has been continuously adjusted with the opening movement of the closing piston 28 and, thereby, of the bypass closing valve 18 so that, when reaching the terminal position of the closing piston 28, the driving means 11 has already been controlled back into its idling speed planned for the circulation delivery.

When the control valve 16 is then reopened, a pertinent flow through the passage 26 develops and the necessary reduction of the pressure of the Venturi tube 34 is brought about which withdraws the adjusting piston 30 once again into the position depicted in FIG. 2 and closes the branch duct 27. Also with this adjustment, a continuous adjustment of the control element takes place so that, when the terminal position of the closing valve 18 is reached, the driving means 11 is already controlled once more into its operating point so that pressure pump 10 delivers the desired high pressure. It can be achieved thereby that the regulation of the driving means is effected in a continuous manner with the desired increase or reduction in performance power and this without any time lag and independently of the pressure fluctuations and pressure peaks occurring in the pressure pipe since, after all, a direct dependence on the position of the bypass valve results so that an optimal performance adaptation is possible. Especially a two-stroke internal combustion engine is capable of accelerating very rapidly because its mass moment of inertia is low and each revolution delivers energy.

For this advantageous operating method it is immaterial whether the end 37 of the Bowden control cable 21 is connected direct to the valve body 25, to the closing element 20 or to the members connected therewith, such as the closing piston 28 or the adjusting piston 30, provided that the described operation is ensured. For the connection of the Bowden control cable 21, the end of the piston rod 20*a* is passed out from the valve body 25, while a seating is ensured with the aid of the sealing ring 39.

Figure 5:
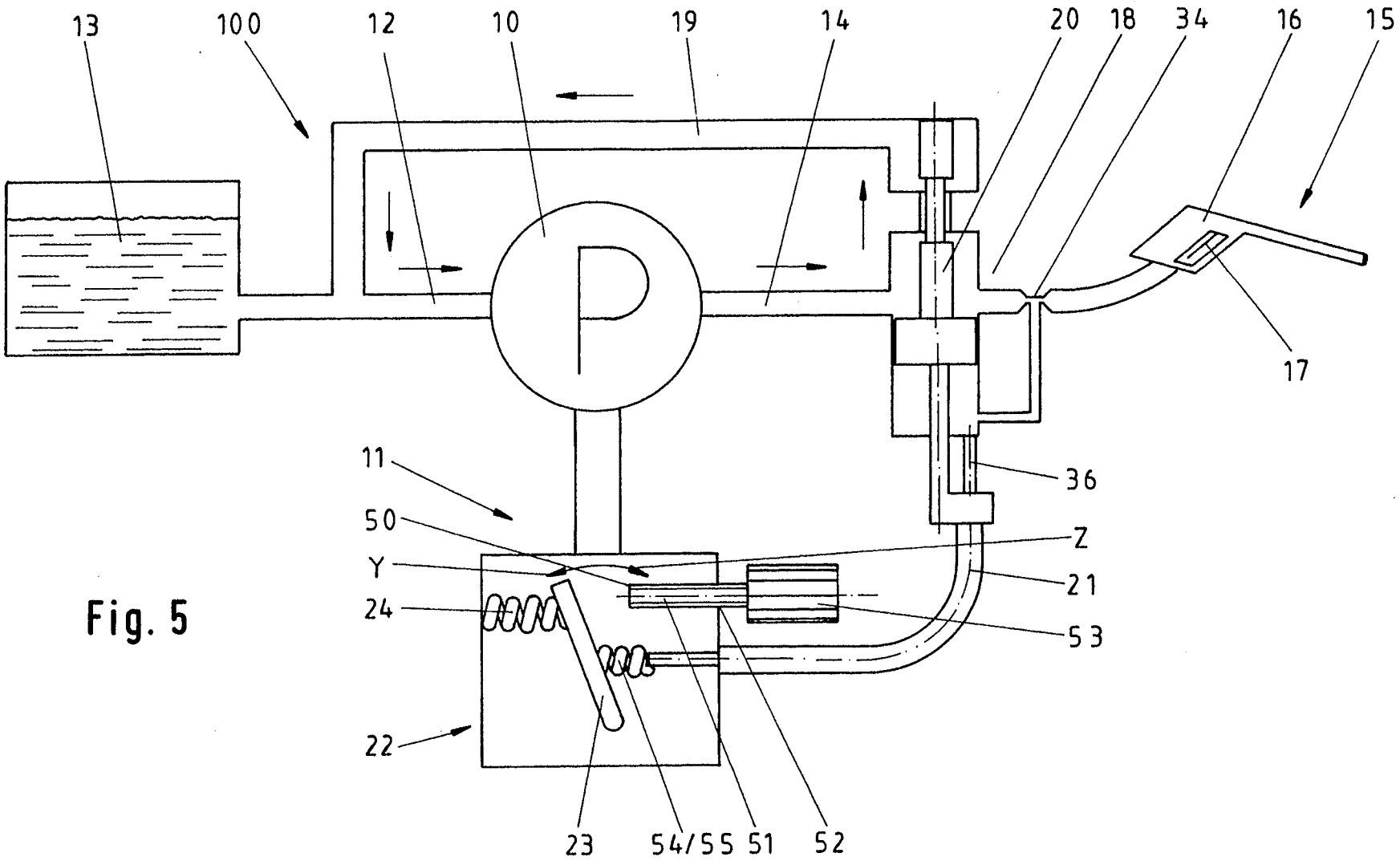
FIG. 5 shows, in a schematic representation, a further embodiment of a pressure jet cleaning appliance in idling operation with adjustable power limiting stop on the drive control element.
Figure 6:
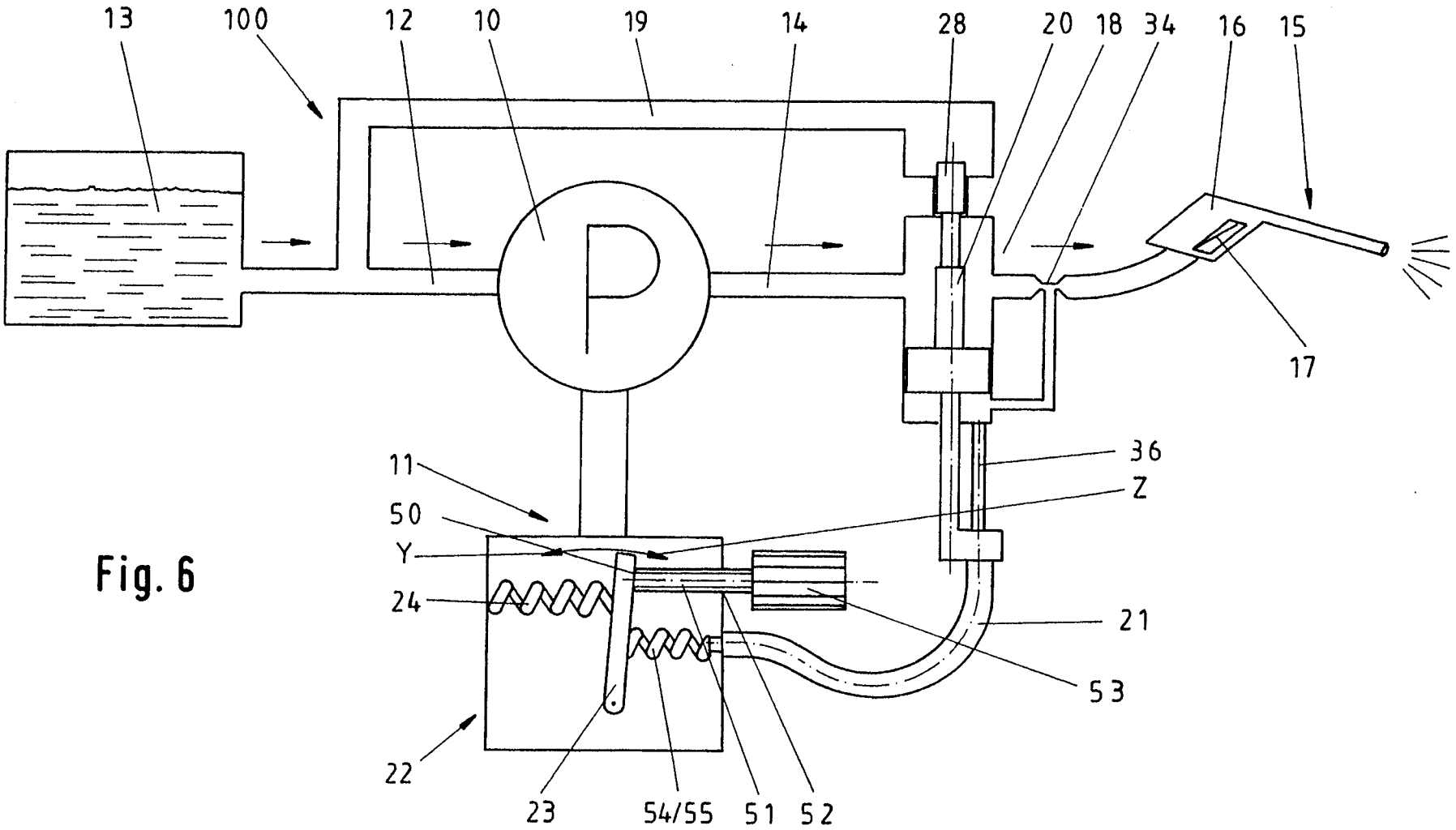
FIG. 6 shows the pressure jet cleaning appliance according to FIG. 5 in partial load operation.

In the FIGS. 5 and 6, the basic construction of a further embodiment of a pressure jet cleaning appliance 100 is illustrated which, in its basic design, corresponds to the embodiment according to FIG. 1 so that reference is made to the foregoing description.

As already described hereinbefore, the control element 22, which may be disposed so as to be swivelable and/or rotatable and, in the embodiment depicted, is a swivelable part 23 of the throttle control rod, is connected with the throttle valve of the internal combustion engine and is swivelable between an idling position (FIG. 5) and a full-throttle position (not shown). In the swivel region of the part 23, a stop 50 is disposed which, by way of example, is formed by the point of a threaded bolt 51 so that the point of impingement of the part 23 on the stop 50 is adjustable. The adjustment is effected by means of a handle in the form of a rotary knob 53 or the like attached to the bolt and located outside the indicated housing. If the control valve of the spray gun 15 is opened, then the bypass valve closes, whereby, due to the direct operative connection between the closing element 20 and the control element 22, the throttle control rod 23 is swiveled in the direction Z. If the adjustment screw 53 is set to a pressure below maximum then the throttle control rod 23 impinges upon the stop surface 50 (FIG. 6). A further swiveling is not possible then. However, since the path of the closing element 20 is greater than the restricted swiveling path, the drawing cable 36 of the Bowden control cable 21 is moved further in a continuing movement of the closing element 20 and it pulls apart the energy storage means 54 in the form of a tension spring 55. In this case it will have to be provided that the tension spring 55, relative to the spring 24, is selected so as to have a higher spring constant in order to ensure that the moment applied by the spring 55 is greater than the countermoment applied by the spring 24 since otherwise, in an "opening of the lance", the Bowden control cable 21 is moved, it is true, but the spring 55 intercepts the travel and the part 23 is not moved in the direction half throttle/full throttle.

Figure 7:
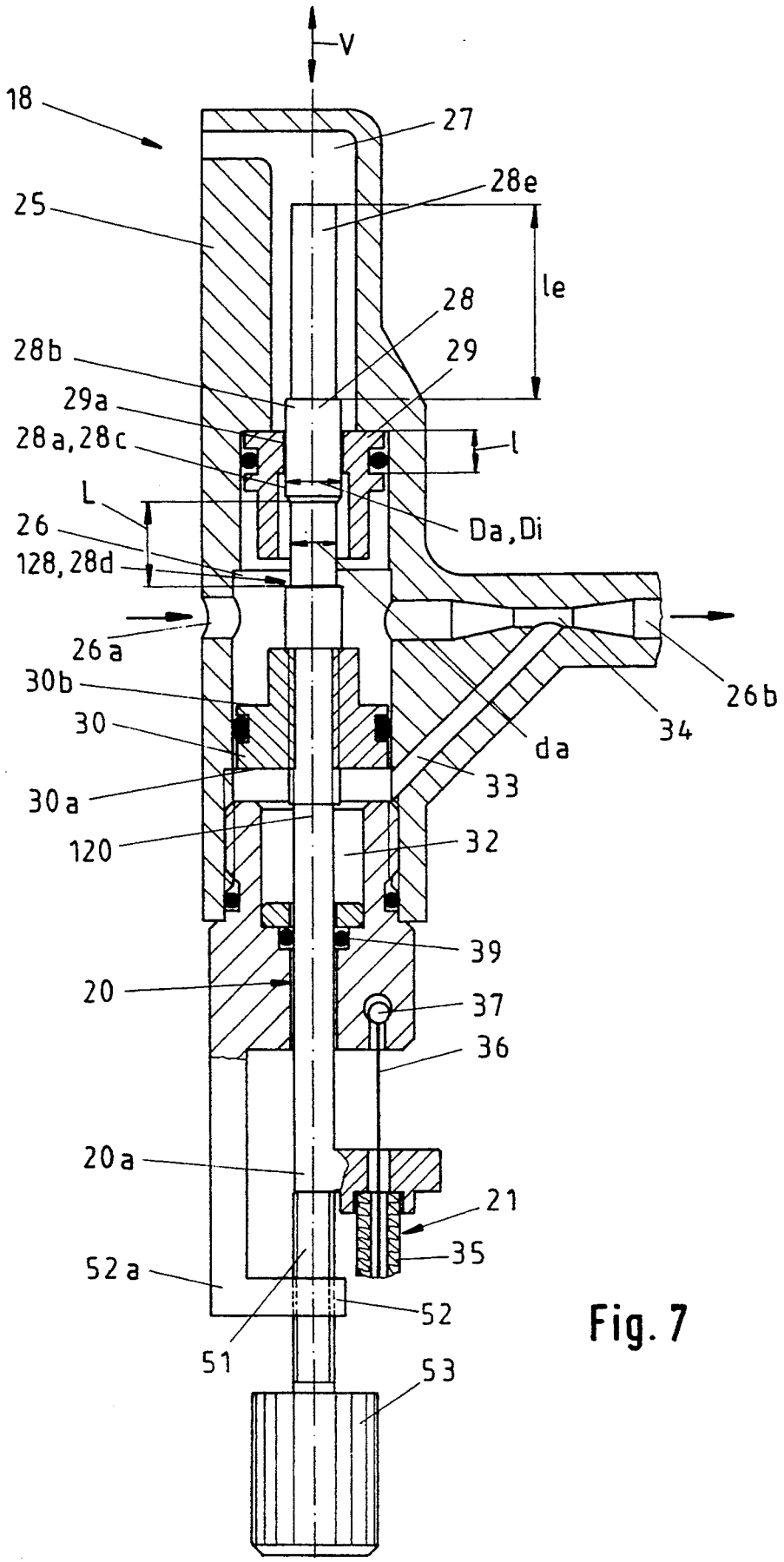
FIG. 7 shows, in a vertical sectional representation, a further embodiment of a bypass closing valve with adjustable power limiting stop at the bypass valve in partial load operating position.
Figure 8:
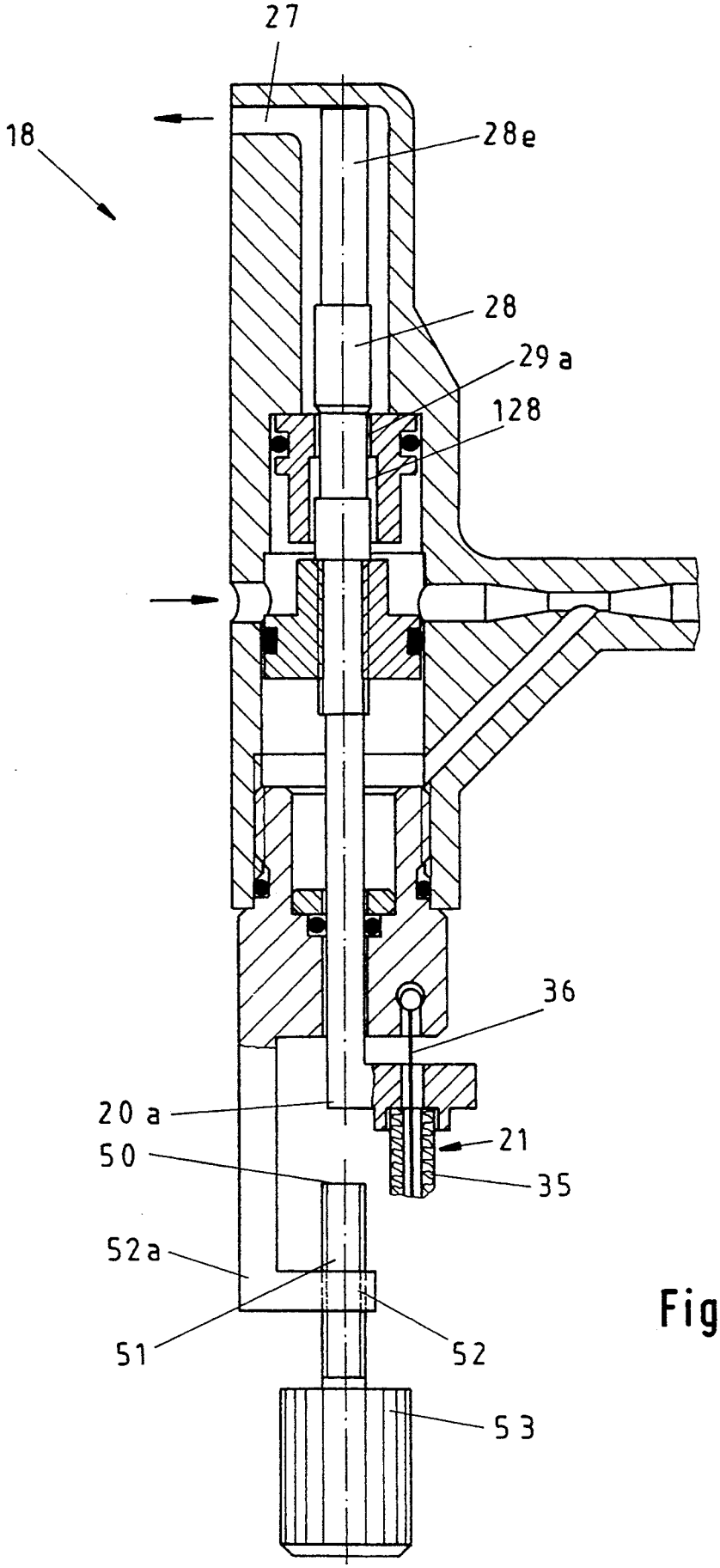
FIG. 8 shows the bypass closing valve according to FIG. 7 in the opened position.

According to a further embodiment of the invention, as is illustrated in the FIGS. 7 and 8, the stop 50 is formed by a threaded bolt 51 which, by means of a bore 52, can be screwed onto an arm 52*a* of the valve body 25. In this case the stop 50 serves as a direct travel limit for the closing element 20 since the piston rod 120, when displaced in the direction V, impinges upon the stop 50. It is then no longer possible to transmit any movement to the Bowden control cable 21 so that the same effect results here as described above. An equalizer spring is not required in this embodiment.

What is claimed is:

1. A pressure let cleaning apparatus having a spray gun comprising:
   - a fluid source;
   - a conduit having a primary line coupling the fluid source with the spray gun and a bypass line for recycling fluid through the conduit;
   - a pump coupled to the primary line for pumping the fluid through the conduit;
   - a drive, operably coupled to the pump, for driving the pump, the drive having a control element for regulating the speed of the drive; and
   - a control valve positioned on the primary line and directly connected to the control element of the drive, the control valve having a closing element that is movable between an open position, where the fluid is directed along the primary line to the spray gun, and a closed position, where the fluid is redirected along the bypass line back to the primary line downstream of the pump, the closing element actuating the control element to reduce the speed of the drive when the closing element is in the closed position and to increase the speed of the drive when the closing element is in the open position.

2. The apparatus of claim 1 wherein the closing element and the control element are connected by a Bowden control cable.

3. The apparatus of claim 2 wherein the Bowden control cable is connected to the control element by an energy storage device.

4. The apparatus of claim 3 wherein the energy storage device is a tension spring.

5. The apparatus of claim 1 wherein the control valve comprises:
   - a body having a chamber with a sealing member, an inlet in communication with the primary line upstream of the valve, a first outlet in communication with the bypass line and a second outlet in communication with the primary line downstream of the valve; and
   - a piston reciprocable within the chamber between the open position, where the piston engages the sealing member so that the first outlet is fluidly isolated from the inlet, and the closed position, where the piston is disengaged from the sealing member so that the first outlet is fluidly coupled to the inlet.

6. The apparatus of claim 5 wherein the sealing member comprises a sleeve having a sealing portion with an internal diameter, the piston having a sealing section with an outer diameter and a cross-sectional area and a flow section with a cross-sectional area, the internal diameter of the sealing portion corresponding to the outer diameter of the sealing section and the cross-sectional area of the flow section being smaller than the cross-sectional area of the sealing section.

7. The apparatus of claim 6 wherein the flow section has at least one groove for allowing fluid to pass through from the primary line to the bypass line when the piston is in the closed position.

8. The apparatus of claim 6 wherein the flow section has an axial length that is longer than an axial length of the sealing section.

9. The apparatus of claim 6 wherein the flow section has at least one guiding surface with an outer diameter substantially .equal to the internal diameter of the sealing section.

10. The apparatus of claim 1 wherein the drive further includes means for adjusting the speed of the drive when the closing element is in the open position.

11. The apparatus of claim 10 wherein the adjusting means is a rotatable threaded bolt disposed on the control element of the drive.

12. The apparatus of claim 11 wherein the threaded bolt has a rotatable handle to facilitate adjustment of the speed of the drive.

13. A pressure jet cleaning apparatus having a spray gun comprising;
   - a fluid source;
   - a conduit having a primary line coupling the fluid source with the spray gun and a bypass line for recycling fluid through the conduit;
   - a pump on the primary line for pumping the fluid through the conduit;
   - a drive, operably coupled to the pump, for driving the pump, the drive having a control element with a throttle control rod for regulating the speed of the drive; and
   - a control valve positioned on the primary line and directly connected to the control element of the drive, the control valve having a piston that is movable between an open position, where the fluid is directed along the primary line to the spray gun, and a closed position, where the fluid is redirected along the bypass line back to the primary line downstream of the pump, the piston being directly connected to the throttle control rod by a control cable such that movement of the piston is translated into displacement of the control rod, the piston actuating the control rod to reduce the speed of the drive when the piston is in the closed position and to increase the speed of the drive when the piston is in the open position.

14. A pressure jet cleaning apparatus having a spray gun with an internal control valve comprising;
   - a fluid source;
   - a conduit having a primary line coupling the source of fluid with the spray gun and a bypass line for recycling fluid through the conduit;
   - a pump on the primary line for pumping the fluid through the conduit;
   - a drive, operably coupled to the pump, for driving the pump, the drive having a control element for regulating the speed of the drive; and
   - a control valve positioned on the primary line and directly connected to the control element of the drive, the control valve having a reciprocable piston that is responsive to fluid pressure within the primary line to move between an open position, where the fluid is directed along the primary line to the spray gun, and a closed position, where the fluid is redirected along the bypass line back to the primary line downstream of the pump, the piston actuating the control element to reduce the speed of the drive when the piston is in the closed position and to increase the speed of the drive when the closing element is in the open position.

15. The apparatus of claim 14 wherein the piston has a first face in communication with the primary line and a second face, the control valve further including a conduit that fluidly couples the second face of the piston with the primary line downstream of the valve, the second face having a larger surface area than the first face so that a substantially equal pressure on both the faces will cause the piston to move toward the first face into the closed position.

* * * * *